United States Patent [19]

Del'Re

[11] Patent Number: 4,993,605

[45] Date of Patent: Feb. 19, 1991

[54] CLOSURE ASSEMBLY WITH POURING SPOUT AND MEASURING CUP

[75] Inventor: Salvatore N. Del'Re, Marlboro, N.J.

[73] Assignee: Colgate-Palmolive Company, Piscataway, N.J.

[21] Appl. No.: 272,154

[22] Filed: Nov. 16, 1988

[51] Int. Cl.[5] ..... B65D 47/40

[52] U.S. Cl. ..... 222/545; 222/109

[58] Field of Search ..... 222/108–109, 222/111, 424, 481, 482, 544–545, 548, 551, 562, 566; 215/228, 330

[56] References Cited

U.S. PATENT DOCUMENTS

| | | | |
|---|---|---|---|
| 2,185,699 | 1/1940 | Zeugner | 141/381 |
| 2,763,402 | 9/1956 | Livingstone | 222/109 |
| 2,763,403 | 9/1956 | Livingstone | 222/111 |
| 3,240,404 | 3/1966 | Porter et al. | 222/521 |
| 3,300,104 | 1/1967 | Burt | 222/482 |
| 3,319,842 | 5/1967 | Miller | 222/479 |
| 3,339,772 | 9/1967 | Miller | 215/40 |
| 3,361,307 | 1/1968 | Clare | 222/489 |
| 3,563,422 | 2/1971 | Cruikshank | 222/478 |
| 3,980,211 | 9/1976 | Owens | 222/478 |
| 4,133,462 | 1/1979 | Lindstrom | 222/546 |
| 4,253,459 | 3/1981 | Willis | 222/567 X |
| 4,261,475 | 4/1981 | Babiol | 215/341 |
| 4,264,022 | 4/1981 | Perne et al. | 222/547 |
| 4,550,862 | 11/1985 | Barker et al. | 222/109 |
| 4,600,131 | 7/1986 | Roof et al. | 222/478 |
| 4,696,416 | 9/1987 | Muckenfuhs et al. | 222/109 |
| 4,706,829 | 11/1987 | Li | 215/354 |
| 4,773,560 | 9/1988 | Kittscher | 222/109 |
| 4,830,234 | 5/1989 | Odet | 222/465.1 |

FOREIGN PATENT DOCUMENTS

| | | | |
|---|---|---|---|
| 0052059 | 5/1982 | European Pat. Off. . | |
| 0109704 | 5/1984 | European Pat. Off. . | |
| 0132875 | 2/1985 | European Pat. Off. . | |
| 1196089 | 7/1965 | Fed. Rep. of Germany | 222/111 |
| 8431343 | 4/1985 | Fed. Rep. of Germany . | |
| 1407057 | 11/1965 | France . | |
| 2442196 | 6/1980 | France . | |

*Primary Examiner*—Michael S. Huppert

*Attorney, Agent, or Firm*—Richard J. Ancel; Michael J. McGreal; Robert C. Sullivan

[57] ABSTRACT

This invention relates to a closure device for a container and, more particularly, to a three-piece assembly, including a measuring cup and a pouring spout, as well as a container. The measuring cup is provided with an internally threaded skirt for engaging the threaded neck of the container for squeezing the neck with a half-round bead on the member having the pouring spout to form a tight seal between the pouring spout and the measuring cup. The member including the pouring spout includes a truncated conical body tightly press fitted into the neck of the container and is provided with other sealing means between the pouring spout and the container.

11 Claims, 3 Drawing Sheets

FIG. 2
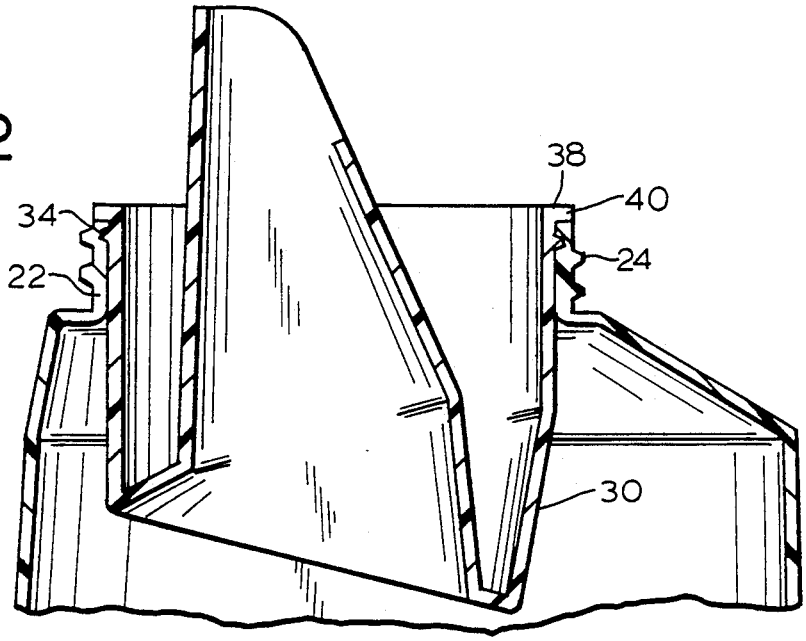
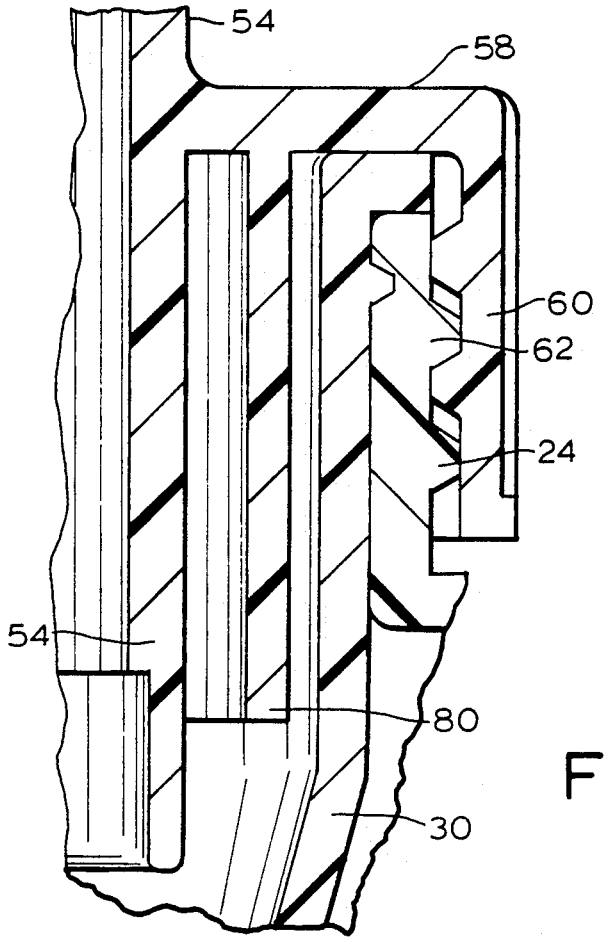
FIG. 3

CLOSURE ASSEMBLY WITH POURING SPOUT AND MEASURING CUP

BACKGROUND OF THE INVENTION

1. Field of the Invention

This invention relates to a closure assembly for a container and, more particularly, to a three-piece assembly including a pouring spout and a measuring cup, as well as a container.

2. Description of the Prior Art

Various types of pouring spouts for containers have been developed in the past. These pouring spouts usually are separate and apart from the cap provided for the container. During use of the pouring spout, because there is no tight seal provided for the pouring spout, there is likely to be leakage between the pouring spout and the container, as well as leakage between the cap and pouring cap spout. When not in use, because there is no positive seal between the pouring spout and the cap, leakage may cause the assembly to become coated with the solution dispensed from the container. Further, evaporation of the contents may occur.

One step in the development of this closure assembly was the development of the closure assembly described in German Utility Model Patent No. G 84 31 343.9, which is incorporated herein by reference. The present invention is an improvement thereover by provision of a flange with an upwardly extending bead, with engages the under surface of a radial wall on the measuring cup. This forms a circular line seal with the flange providing suitable flexibility to insure a sufficiently good seal so that the container with the closure assembly can pass the fluid immersion test.

Another development from the closure assembly shown in German Utility Model Patent No. G 84 31 343.9 is the closure assembly described in U. S. Pat. No. 4,706,829 issued Nov. 17, 1987 to Ernest L. Li. This invention utilizes various other types of seals, but is not believed to have been able, on a mass produced scale, to pass the fluid immersion test, thus, being likely to exude a surfactant or the like contained therein.

The present invention overcomes these difficulties by providing for a forced seal caused by the combination measuring cup and cap when secured over the pouring spout. Furthermore, because of the configuration and location of the half-round bead, a better seal is formed between the pouring spout and the cap. Accordingly, a first seal is achieved between the cap and the pouring spout, and a second seal is achieved between the pouring spout and the container, thus preventing leakage or evaporation.

SUMMARY OF THE INVENTION

The present invention contemplates a three-piece assembly, including a container. The assembly includes a first member, which has a tapered body having an integral pouring spout. The tapered body is in the form of a truncated cone and has at its upper peripheral edge an outwardly-extending peripheral lip provided with an upwardly extending half-round bead. The neck of the container is externally threaded for receiving thereabout an internally threaded skirt on the second member, which is in the form of a measuring cup. When the skirt is threaded about the neck of the container, the bead engages the measuring cup to form a first seal and a second seal is provided between the neck of the container and the tapered body.

BRIEF DESCRIPTION OF THE INVENTION

FIG. 2 is a vertical sectional view of the closure assembly and a portion of the container with the combination measuring cup and cap removed;

FIG. 3 is an enlarged sectional detail view illustrating the closure assembly in its sealed position.

DETAILED DESCRIPTION OF THE INVENTION

Figure 4:
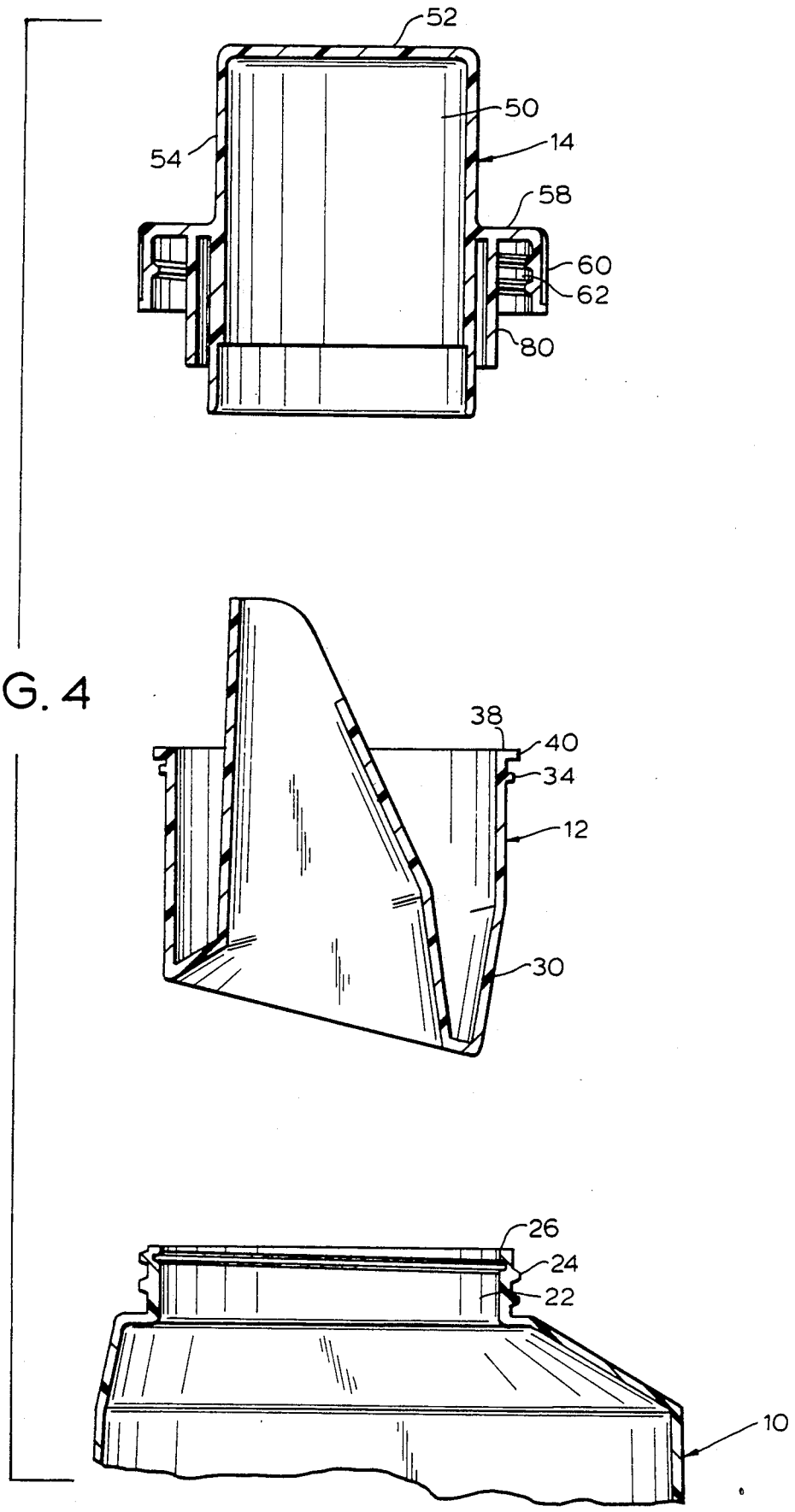
FIG. 4 is an exploded sectional detail view of the closure assembly.

With continuing reference to the accompanying drawings, wherein like reference numerals designate similar parts throughout the various views, and with initial attention directed to FIG. 4, there is shown, for use with a container 10 and further including a first member 12 and a second member 14.

The container 10 is preferably molded of a synthetic plastic material compatible with the contents for which it is to be used, such as laundry detergents, bleach, fabric softeners, potable beverages or any other useful material. The container 10 includes a main portion 20, which terminates in a neck 22. The neck 22 is externally threaded, as illustrated at 24. The neck 22 has an upper peripheral edge 26.

Referring now the first member 12, there is provided a tapered body 30, which is of a truncated conical configuration extending downwardly and inwardly. Integral with the body 30 is a pouring spout 32 of any selected and desired shape. On the upper outside surface of the body 30 there are provided prongs 34 in the form of unbroken circumferential beads or ribs having a half-round cross sectional configuration and preferably two or three in number for facilitating the sealing of the member 12 in the neck 22.

The upper peripheral edge 38 of the body 30 is provided with a peripherally and outwardly extending lip 40, which has a bead 42 of a half-round cross sectional configuration upwardly extending thereform. The entire first member 12 is suitably molded from a synthetic plastic material and is press fitted into the neck.

One of the additional features of the invention is that the upper edge 26 of the neck 22 is bevelled and engages the undersurface 44 of the lip 40 to form a continuous circular line seal.

The second member 14 includes a measuring cup 50 which has a top portion 52 and cylindrical side walls 54, which terminate in a lower peripheral edge 56. Integral with the side walls 54 is an outwardly extending skirt 60, which is internally threaded at 62.

Figure 1:
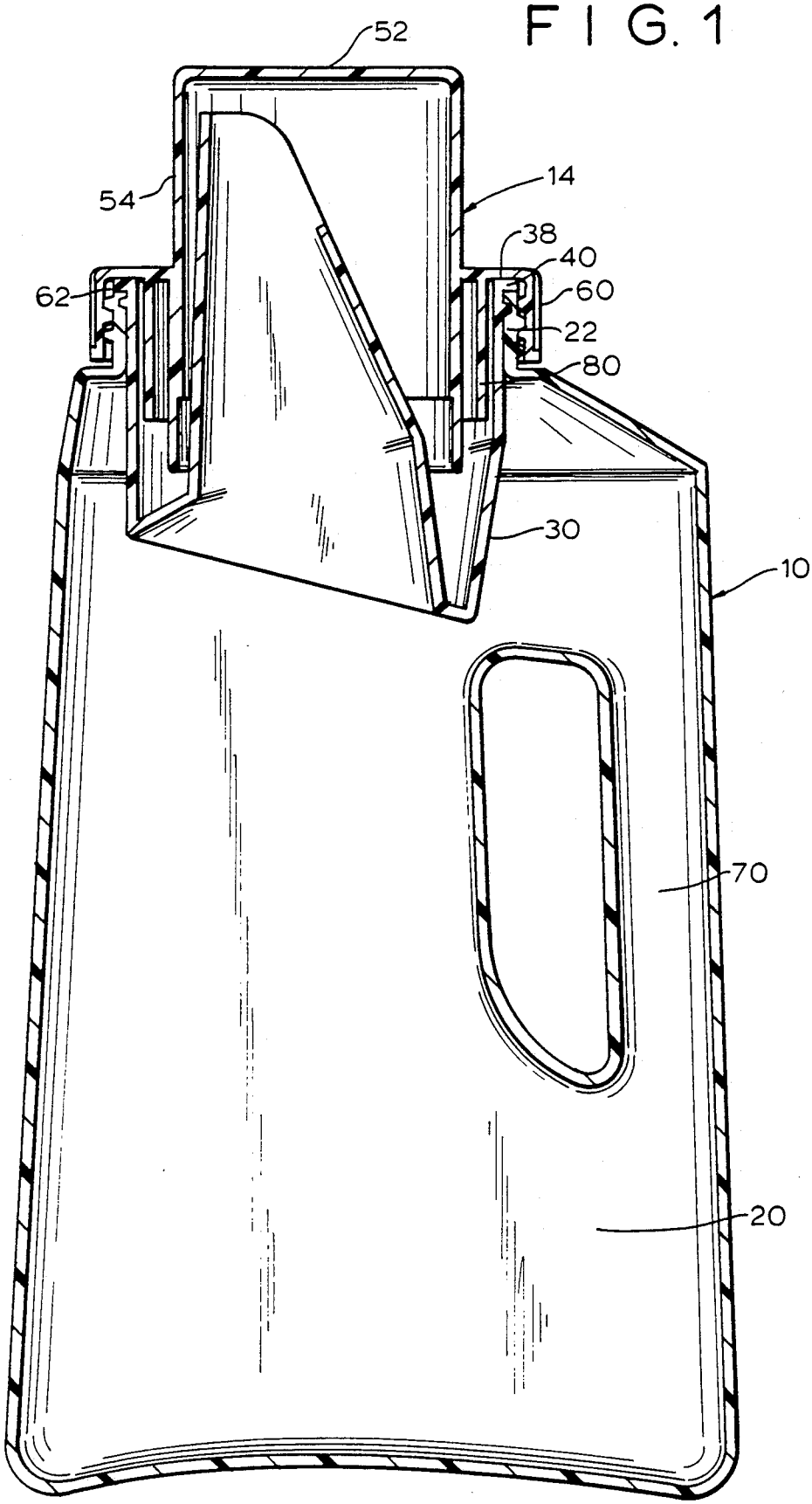
FIG. 1 is a vertical sectional view of the closure assembly including a container.

As can be seen in FIGS. 1 and 2, the closure assembly is especially adapted for large containers, such as are commonly used for laundry detergents, and which may have an integrally molded handle 70. The first member is press fitted into the neck 22 of the container 10 with the pronges 34 assuring proper seating of the body 30 in the neck 22 and sealing against passage fluid between the neck 22 and the ribs 34. Then, the second member is threaded in place over the neck to form the seal as seen best in FIG. 3.

Upon observation of FIG. 3, it will be seen that a seal is formed between the bead 42 and the lower surface 59 of the flange 58. This will assure against unwanted leakage and evaporation of the contents of the container.

What is claimed is:

1. A closure assembly for a container having a neck comprising a pouring spout having a tapered body receivable within said neck, first means on said tapered body for resiliently engaging said neck and forming a seal therewith when press-fitted into said neck, the upper edge of said neck being beveled, said tapered body having an outwardly extending peripheral lip having a continuous protrusion thereon and closure means for engaging the peripheral lip of said pouring spout and urging said peripheral lip and continuous protrusion into sealing engagement with said closure means, said peripheral lip being resilient whereby it can move downwardly upon contact by said closure means into the beveled region of said neck to assure said sealing engagement.

2. A closure assembly according to claim 1, wherein is a said protrusion is a half-round protrusion on said lip.

3. A closure assembly for a container having a neck comprising a first member adapted to be seated in the neck, said first member including a downwardly tapered truncated conical outer body having a pouring spout integral therewith, said first member seating in said neck, said neck being beveled on its upper edge and having external threads, a measuring cup forming a cap for said container, threaded means on said measuring cup for engagement with said external threads on said neck, sealing means on said body, said sealing means including a plurality of circumferential ribs on said body engaging said neck and a further sealing means including a peripheral lip and an upwardly extending bead on said peripheral lip to contact said cap, said peripheral lip being resilient whereby upon engagement by said cap said peripheral lip can move downwardly into the bevel of said neck to assure sealing.

4. A closure assembly according to claim 3, wherein said bead is of a half-round cross sectional configuration.

5. A closure assembly according to claim 3, wherein said threaded means on said cup includes an outwardly extending flange and a skirt downwardly depending from said flange, said skirt being internally threaded.

6. A closure assembly according to claim 3, wherein said sealing means further includes a peripherally and upwardly extending bead on the upper edge of said body, said thread means including a flange integral with said cup, and an internally threaded skirt depending from said flange, said bead engaging said flange.

7. A closure assembly according to claim 6, wherein said bead is of a half-round cross sectional configuration.

8. A closure assembly according to claim 3, wherein said first member is integrally molded of a synthetic plastic material.

9. A closure assembly for a container having a neck comprising a first member adapted to be seated in sealing engagement with the inner peripheral wall of said neck, said first member including a downwardly tapered truncated conical outer body having a pouring spout integral therewith, said body seating in said neck, said neck being beveled on its upper edge and having external threads, a measuring cup forming a cap for said container, threaded means on said measuring cup for engagement with said neck, and sealing means on said body, said sealing means including an outwardly extending resilient peripheral lip on the upper edge of said body, said resilient peripheral lip movable into the region of the bevel of said neck by said measuring cup and an upwardly extending bead on said lip, said bead engaging said measuring cup to form a seal when said measuring cup engages said neck.

10. A closure assembly according to claim 9, wherein said threaded means on said cup includes an outwardly extending flange and a skirt downwardly depending from said flange, said skirt being internally threaded, said bead engaging said flange.

11. A closure assembly according to claim 9, including a plurality of circumferential ribs for sealing said body in said neck.

* * * * *